US009902160B2

(12) United States Patent
Sugiyama et al.

(10) Patent No.: US 9,902,160 B2
(45) Date of Patent: Feb. 27, 2018

(54) SUPPLY APPARATUS, PRINTING APPARATUS, AND ATTACHMENT METHOD

(71) Applicant: CANON KABUSHIKI KAISHA, Tokyo (JP)

(72) Inventors: Toshiro Sugiyama, Yokohama (JP); Noriyuki Aoki, Tokyo (JP); Shigeru Watanabe, Yokohama (JP); Tsutomu Obata, Tokyo (JP); Naoaki Wada, Yokohama (JP); Ryohei Maruyama, Kawasaki (JP); Ryuichi Kato, Yokohama (JP); Kouhei Tokuda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/266,699

(22) Filed: Sep. 15, 2016

(65) Prior Publication Data

US 2017/0087854 A1 Mar. 30, 2017

(30) Foreign Application Priority Data

Sep. 30, 2015 (JP) ..... 2015-194401

(51) Int. Cl.
*B41J 2/175* (2006.01)

(52) U.S. Cl.
CPC ..... *B41J 2/1752* (2013.01); *B41J 2/17553* (2013.01)

(58) Field of Classification Search
CPC ..... B41J 2/1752; B41J 2/17553; B41J 2/175; B41J 2/17523; B41J 2/17509; B41J 2/17566; B41J 2/17503
USPC ..... 347/7, 84, 85, 86
See application file for complete search history.

(56) References Cited

U.S. PATENT DOCUMENTS

| | | | | |
|---|---|---|---|---|
| 6,168,268 | B1 | 1/2001 | Sugiyama | 347/89 |
| 8,602,513 | B2 | 12/2013 | Ara et al. | 347/7 |
| 8,678,574 | B2 | 3/2014 | Adachi | B41J 2/175 |
| 9,102,162 | B2 | 8/2015 | Watanabe et al. | B41J 2/19 |

FOREIGN PATENT DOCUMENTS

| | | |
|---|---|---|
| JP | 2007-076004 | 3/2007 |
| JP | 2013-212683 | 10/2013 |

OTHER PUBLICATIONS

U.S. Appl. No. 15/272,015, filed Sep. 21, 2016.

*Primary Examiner* — Jannelle M Lebron
(74) *Attorney, Agent, or Firm* — Fitzpatrick, Cella, Harper & Scinto

(57) ABSTRACT

A supply apparatus includes a holder for a liquid container, a link coupled to the holder, an operation handle rotatably coupled to the link, an engaging portion and a rotation restriction unit. The operation handle operate connection and disconnection of the liquid container to and from a supplying portion by rotation with respect to the link. The engaging portion maintains a connection state between the supplying portion and the liquid container by engaging with the operation handle. The unit can restrict rotation of the operation handle when the engaging portion and the operation handle are in a disengaged state.

10 Claims, 9 Drawing Sheets

SUPPLY APPARATUS, PRINTING APPARATUS, AND ATTACHMENT METHOD

BACKGROUND OF THE INVENTION

Field of the Invention

The present invention relates to a supply apparatus, a printing apparatus, and an attachment method.

Description of the Related Art

As an inkjet printing apparatus which mainly prints an image on a large-sized printing medium, a printing apparatus is proposed which includes an ink tank detachably from an apparatus main body and supplies ink to a printhead via a tube. A supplying portion such as a supply needle is provided in a containing portion of the ink tank, and the ink tank is detachable from the supplying portion. In order to use up the ink in the tank, a joint portion serving as a supply port is provided at the bottom of the ink tank, and the ink tank is detachable from the supplying portion in the vertical direction.

A predetermined force may be required to attach/detach the joint portion of the ink tank to/from the supplying portion. For example, when the supply needle is used, the ink in the ink tank can be supplied to the apparatus by inserting/removing the supply needle into/from the joint portion of the ink tank. A predetermined force is required to insert/remove the supply needle, and thus a mechanism which assists insertion/removal operations of a user is proposed. For example, Japanese Patent Laid-Open No. 2013-212683 discloses a mechanism which assists insertion/removal operations by rotating an operation handle (operation lever).

A lift operation of moving the ink tank up and down with respect to the supplying portion is needed in order to mount/remove the ink tank in/from the containing portion. In particular, the amount of that movement becomes large in a lift operation of a compact ink tank for an arrangement in which ink tanks having different volumes are contained in the common containing portion. In an arrangement in which the operation handle is rotated, the operation handle rotates and becomes unstable in the lift operation.

SUMMARY OF THE INVENTION

The present invention provides a technique of improving stability of an operation handle.

According to one aspect of the present invention, there is provided a supply apparatus comprising: a supplying portion configured to supply a liquid in a liquid container to an outside of the liquid container; a holder configured to mount a liquid container; a link coupled to the holder; an operation handle rotatably coupled to the link, and configured to operate connection and disconnection of a liquid container mounted on the holder to and from the supplying portion by rotation with respect to the link; an engaging portion configured to maintain a connection state between the supplying portion and a liquid container mounted on the holder by engaging with the operation handle; and a rotation restriction unit configured to be capable of restricting rotation of the operation handle with respect to the link when the engaging portion and the operation handle are in a disengaged state.

Further features of the present invention will become apparent from the following description of exemplary embodiments (with reference to the attached drawings).

DESCRIPTION OF THE EMBODIMENTS

<Overview of Printing Apparatus>

Figure 1:
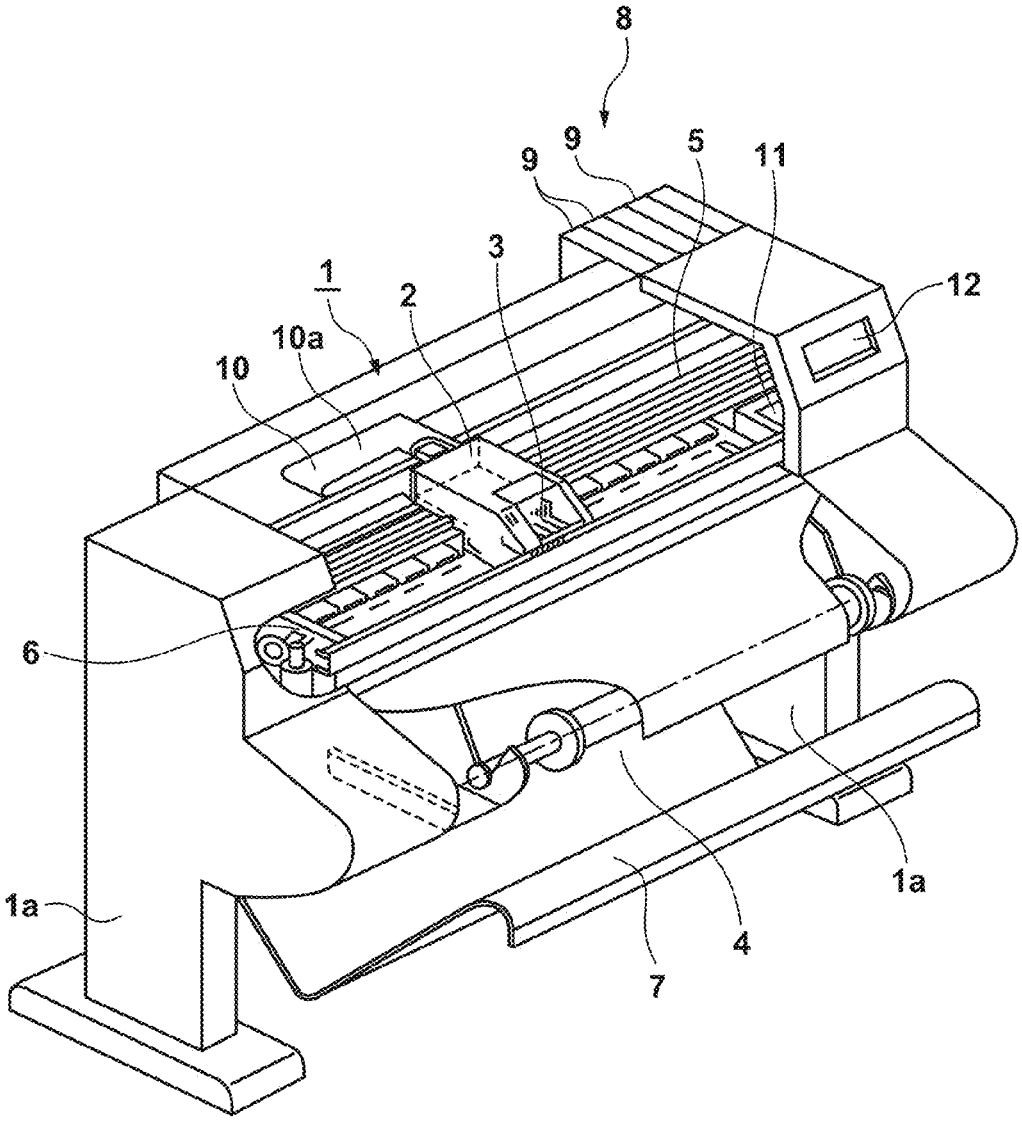
FIG. 1 is a schematic view showing a printing apparatus to which an embodiment of the present invention is applied.

FIG. 1 is a schematic view showing a printing apparatus 1 to which an embodiment of the present invention is applied. The printing apparatus 1 is a serial type inkjet printing apparatus.

Note that "print" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans. Additionally, in this embodiment, "printing medium" is assumed to be a paper sheet, but may be cloth, a plastic film, or the like.

The printing apparatus 1 is fixed astride the upper end portions of two legs 1*a* facing each other. A carriage 2 mounts a printhead 3. The printhead 3 prints an image by discharging ink to a printing medium.

When printing the image, the printing medium (here, roll paper) set in a roll holder unit 4 is fed to a printing position in a sub-scanning direction. Then, a carriage motor (not shown) and a belt transmission mechanism 5 move the carriage 2 in a main-scanning direction. In this movement, ink droplets are discharged from respective nozzles of the printhead 3.

When the carriage 2 moves to one end portion of the printing medium in the main-scanning direction, a conveyance roller 6 conveys the printing medium by a predetermined amount in the sub-scanning direction. The image is formed on the entire printing medium by repeating a printing operation and a conveyance operation alternately as described above. After the image is formed, the printing medium is cut by a cutter (not shown), and the cut printing medium is stacked in a stacker 7.

The printing apparatus 1 includes a supply apparatus 8 according to an embodiment of the present invention. The supply apparatus 8 contains a plurality of liquid containers 9. In this embodiment, the liquid containers 9 are ink tanks, and are contained detachably in the vertical direction by being divided for respective ink types such as black, cyan, magenta, and yellow. A supply tube 10 for each liquid container 9 is connected to the supply apparatus 8. The supply tubes 10 are tied into a bundle by a tube guide 10*a* so as not to move around in the reciprocating motion of the carriage 2.

A plurality of nozzle arrays (the illustration thereof is omitted) are formed on a surface facing the printing medium of the printhead 3 in a direction almost perpendicular to the main-scanning direction. The supply tubes 10 are connected for each nozzle array. The ink in the liquid containers 9 is supplied to the nozzle arrays from the supply apparatus 8 via the supply tubes 10.

A recovery unit 11 is further provided outside the range of the printing medium in the main-scanning direction and at a position facing a nozzle surface of the printhead 3. The recovery unit 11 performs, as needed, nozzle cleaning of sucking out ink or air from the surface of a discharge nozzle of the printhead 3, or valve-closing suction of forcibly sucking out air accumulated inside the printhead 3. An operation panel 12 is provided on the right side of the printing apparatus 1. The operation panel 12 can issue, to a user, an announcement to prompt him/her to replace the liquid containers 9 by sending a warning message when the ink in the liquid containers 9 runs out.

<Structure of Supply Apparatus>

Figure 2B:
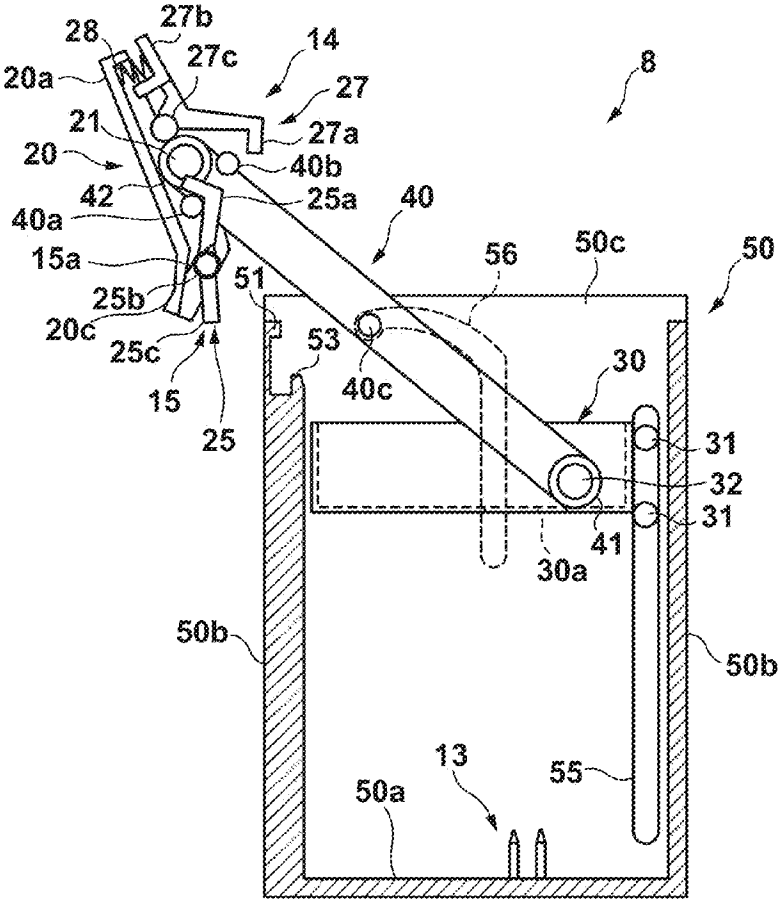
FIGS. 2A and 2B are views for explaining a supply apparatus according to the embodiment of the present invention.
Figure 2A:
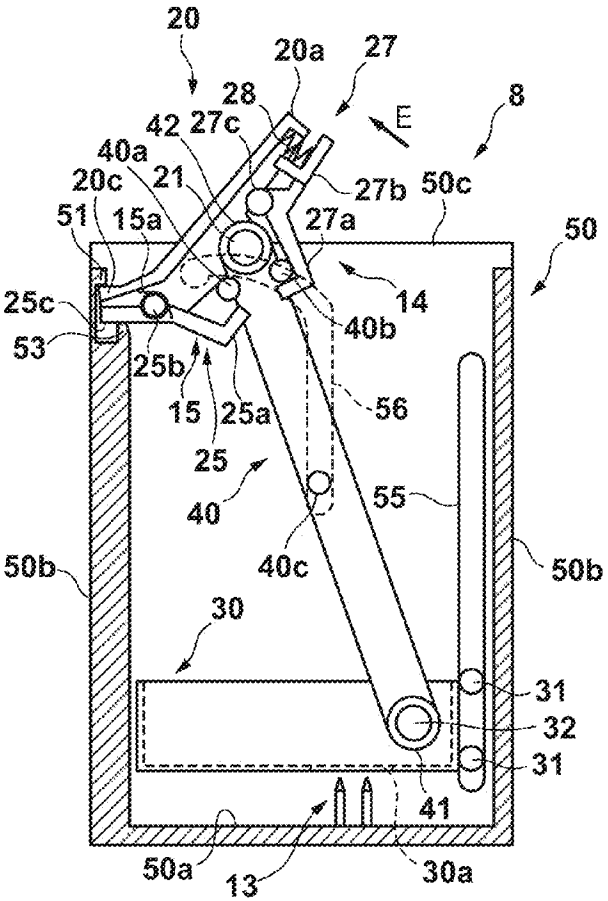

The structure of the supply apparatus 8 will be described. Each of FIGS. 2A and 2B is a vertical sectional view schematically showing the supply apparatus 8. As already described, the supply apparatus 8 contains the plurality of liquid containers 9 divided for the respective types of contained ink. Each of FIGS. 2A and 2B shows the structure of one divided portion.

The supply apparatus 8 includes an operation handle 20, a holder 30, a link 40, and a containing portion 50. The containing portion 50 forms a cylinder with an open upper part, and the liquid containers 9 are put in/taken out from an opening of that upper part. The containing portion 50 contains the holder 30 and at least a part of the liquid container 9 mounted on the holder 30.

The containing portion 50 has a bottom 50*a*, sides 50*b* facing each other, and sides 50*c* facing each other, each of which forms a wall portion defining an internal space of the containing portion 50. Note that only the side 50*c* on one side is shown in each of FIGS. 2A and 2B.

Supplying portions 13 are provided at the bottom 50*a*. The supplying portions 13 are connected to the liquid containers 9 and supply the ink in the liquid containers to the outside of the liquid containers. In this embodiment, the supplying portions 13 are supply needles which protrude upward from the bottom 50*a*, and are connected to and disconnected from the liquid containers 9 by being inserted into/removed from the liquid containers 9. Out of two supply needles, one is an atmosphere communicating supply needle, and the other is an ink supplying supply needle. The atmosphere communicating supply needle communicates with outside air via an air communication port (not shown) and guides air inside the liquid container 9 by a discharged amount of ink in the liquid container 9.

The ink in the liquid containers 9 is discharged to the supply tubes 10 via the supplying portions 13 and supplied to the printhead 3. It is possible to use the ink in the liquid containers 9 to the very end easily by providing the supplying portions 13 at the bottom 50*a* and also, to be described later, providing connected parts of the liquid containers 9 to the supplying portions 13 in a lower part.

On the sides 50*b* facing each other, a guide portion 55 is formed on one side, and a guide portion 56 is formed on the other side. The guide portion 55 is a groove which guides movement of the holder 30. The holder 30 can move, by being guided by the guide portion 55, in a direction closer to and away from (here, the vertical direction) the bottom 50*a* in the containing portion. The guide portion 56 is a groove which guides movement of the link 40. The link 40 can move in an L shape by being guided by the guide portion 56.

An engaging portion 51 and an abutment portion 53 are formed on one of the sides 50*b* facing each other. Their functions will be described later.

The containing portion 50 may contain a plurality of types of liquid containers 9 having different volumes. If a volume difference between two liquid containers 9 is extremely large, for example, assuming that one has a large volume of 800 mL, the other has a small volume of 300 mL, and they are equal in cross section, this makes a height difference of about 150 mm. As in this embodiment, in an arrangement in which the supplying portions 13 are provided at the bottom 50*a*, a lift amount (a vertical moving amount) obtained when the small-volume liquid container 9 is detached from/attached to the containing portion 50 becomes large, requiring the lift amount of 150 mm or more as described above. In this embodiment, the operation handle 20 and the holder 30 are coupled to each other by providing the link 40, making it possible to gain a larger lift amount.

The holder 30 forms a bottomed box shape having an open upper part, and the liquid containers 9 are mounted inside thereof. The holder 30 includes a lock mechanism (not shown). This lock mechanism locks the liquid containers 9 in the holder 30. An opening 30*a* through which the connected parts of the liquid containers 9 connected to the supplying portions 13 pass is formed at the bottom of the holder 30. A rotation shaft 32 is provided on the side of the holder 30. One end portion 41 of the link 40 is rotatably coupled to the rotation shaft 32.

Sliders 31 engaging with the guide portion 55 are provided on the side of the holder 30. The sliders 31 are shafts in this embodiment and can slide the guide portion 55 freely. The holder 30 and the liquid containers 9 move vertically by guidance of the guide portion 55. FIG. 2A shows a case in which the holder 30 is positioned at a position (to be referred to as a connection position) where the liquid containers 9 and the supplying portions 13 are connected to each other. FIG. 2B shows a case in which the holder 30 is positioned at a position (to be referred to as a replacement position) where the liquid containers 9 and the supplying portions 13 are spaced apart from each other, and the liquid containers 9 are replaced.

The link 40 is a rod-shaped member, and its one end portion 41 is coupled to the holder 30 rotatably by the rotation shaft 32. The operation handle 20 is coupled to other end portion 42 of the link 40 rotatably by a rotation shaft 21. The length of the link 40 is set so as to expose the operation handle 20 from the containing portion 50 when the holder 30 is positioned at the connection position.

A slider 40*c* engaging with the guide portion 56 is provided in an intermediate part of the link 40. The slider 40*c* is a shaft in this embodiment and can slide the guide portion 56 freely. The guide portion 56 guides movement of the link 40 and restricts its free movement. Restriction portions 40*a* and 40*b* are provided on the side of the other end portion 42 of the link 40. The restriction portions 40*a* and 40*b* are shafts in this embodiment, and can restrict rotation of the operation handle 20 with respect to the link 40 as will be described later.

The operation handle 20 is configured to operate connection and disconnection of the liquid containers 9 mounted on the holder 30 to and from the supplying portions 13 by rotation with respect to the link 40. The rotation shaft 21 to which the link 40 is coupled is provided at the center of the operation handle 20. An engaging portion 20*c* engaging with the engaging portion 51 is formed at one end portion of the operation handle 20. A grip portion 20*a* assumed to be gripped by the user is provided at the other end portion of the operation handle 20.

The engaging portion 20*c* can engage with the engaging portion 51. FIG. 2A shows an engaged state. A connection state between the supplying portions 13 and the liquid containers 9 mounted on the holder 30 is maintained by this engagement and the rotation restriction of the operation handle 20 with respect to the link 40.

The supply apparatus 8 also includes two rotation restriction units 14 and 15. Both of these rotation restriction units 14 and 15 are mechanisms capable of restricting rotation of the operation handle 20 with respect to the link 40.

The rotation restriction unit 14 can releasably restrict rotation of the operation handle 20 with respect to the link 40 by a user operation. The rotation restriction unit 14 includes a restriction member 27 provided in the operation handle 20 and a restriction portion 40*b* provided in the link 40. The restriction member 27 is a lever-shaped member and is rotatably supported in the operation handle 20 via a rotation shaft 27*c*. A hook-shaped hook portion 27*a* is provided at one end portion of the restriction member 27. A grip portion 27*b* assumed to be gripped by the user is provided at the other end portion of the restriction member 27. The hook portion 27*a* engages with the restriction portion 40*b* as shown in FIG. 2A, disabling the operation handle 20 from rotating with respect to the link 40. Engagement between the hook portion 27*a* and the restriction portion 40*b* is canceled as shown in FIG. 2B, enabling the operation handle 20 to rotate with respect to the link 40.

An elastic member 28 such as a spring is provided between the grip portion 20*a* and the grip portion 27*b*. The elastic member 28 always biases the restriction member 27 in a direction in which the hook portion 27*a* engages with the restriction portion 40*b*. The user grips the grip portion 20*a* and the grip portion 27*b* so as to move the grip portion 27*b* closer to the grip portion 20*a* against biasing by the elastic member 28 as indicated by an arrow E in FIG. 2A, rotating the restriction member 27 in a direction in which the hook portion 27*a* does not engage with the restriction portion 40*b*.

An operation of disabling the operation handle 20 from rotating with respect to the link 40 by the rotation restriction unit 14 (release of the grip portion 20*a* and the grip portion 27*b*) is performed at the completion of attachment of the liquid containers 9, that is, when the holder 30 is maintained at the connection position in FIG. 2A. This maintains engagement between the engaging portion 51 and the engaging portion 20*c*, and the connection state between the liquid containers 9 and the supplying portions 13.

An operation of enabling the operation handle 20 to rotate with respect to the link 40 by the rotation restriction unit 14 (gripping on the grip portion 20*a* and the grip portion 27*b*) is performed when the attached liquid containers 9 are retrieved. That is, the operation is performed when the holder 30 is moved from the connection position in FIG. 2A to the replacement position. Engagement between the engaging portion 51 and the engaging portion 20*c* is canceled by rotating the operation handle 20, setting a disengaged state. Connection between the liquid containers 9 and the supplying portions 13 is also canceled. At this time, the user can shift to a lift operation while gripping the grip portion 20*a* and the grip portion 27*b* without switching his/her hand holding the operation handle 20 from one to the other. This improves operability. This also eliminates a twist of a wrist of the user associated with the operation, improving the operability.

However, if the operation handle 20 can rotate with respect to the link 40 during the lift operation, the operation handle 20 may wobble and lack stability during the lift operation this time. The rotation restriction unit 15 is a mechanism for that measure. The rotation restriction unit 15 can restrict rotation of the operation handle 20 with respect to the link 40 when the engaging portion 51 and the engaging portion 20*c* of the operation handle 20 are in the disengaged state. This can improve the stability of the operation handle 20.

The rotation restriction unit 15 includes a restriction member 25 provided in the operation handle 20 and the restriction portion 40*a* provided in the link 40. The restriction member 25 is a lever-shaped member and is rotatably supported in the operation handle 20 via a rotation shaft 25*b*. A hook-shaped hook portion 25*a* is provided at one end portion of the restriction member 25. A canceling portion 25*c* adjacent to the engaging portion 20*c* of the operation handle 20 is provided at the other end portion of the restriction member 25. The hook portion 25*a* engages with the restriction portion 40*a* as shown in FIG. 2B, disabling the operation handle 20 from rotating with respect to the link 40. When the abutment portion 53 abuts against the canceling portion 25*c* as shown in FIG. 2A, engagement between the hook portion 25*a* and the restriction portion 40*a* is canceled, enabling the operation handle 20 to rotate with respect to the link 40.

The rotation restriction unit 15 includes an elastic member 15*a* which always biases the restriction member 25 in a direction in which it engages with the restriction portion 40*a*. The elastic member 15*a* is, in this embodiment, a coil spring wound around the rotation shaft 25*b*, its one end portion is locked to the operation handle 20, and its other end is locked to the restriction member 25. The hook portion 25*a* engages with the restriction portion 40*a* unless the canceling portion 25*c* is pressed by the abutment portion 53 because of biasing by the elastic member 15*a*. It is therefore possible to prevent the operation handle 20 from rotating with respect to the link 40 during the lift operation.

<Attaching/Detaching Operation of Liquid Container>

An operation of the supply apparatus 8 regarding attachment/detachment of the liquid containers 9 will be described. First, an attachment method of the liquid container 9 will be described with reference to FIGS. 3A to 4B.

Figure 3C:
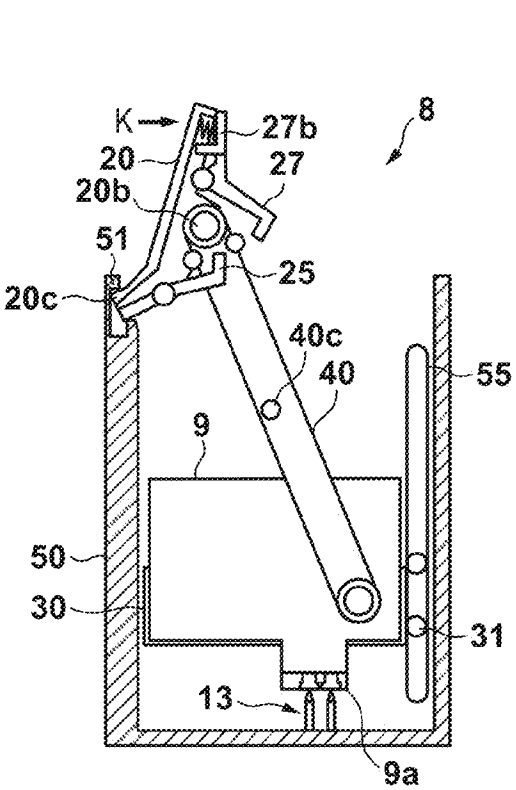
FIGS. 3A to 3C are views for explaining an operation of the supply apparatus in FIGS. 2A and 2B.
Figure 3B:
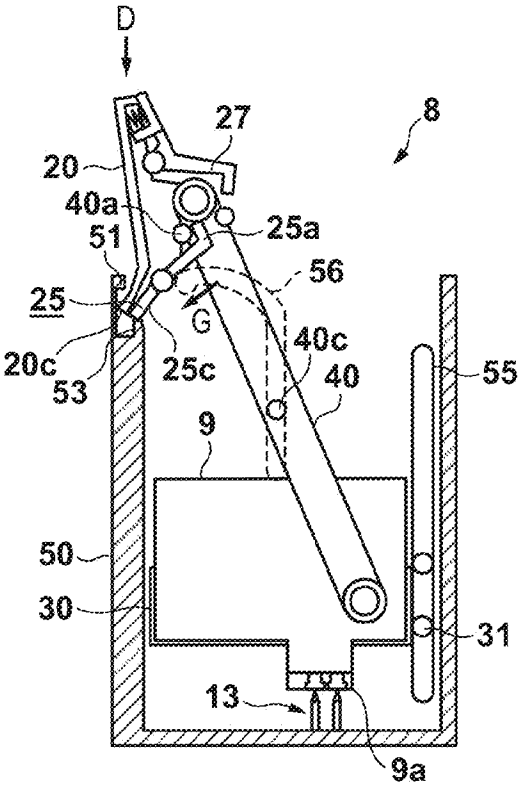
Figure 3A:
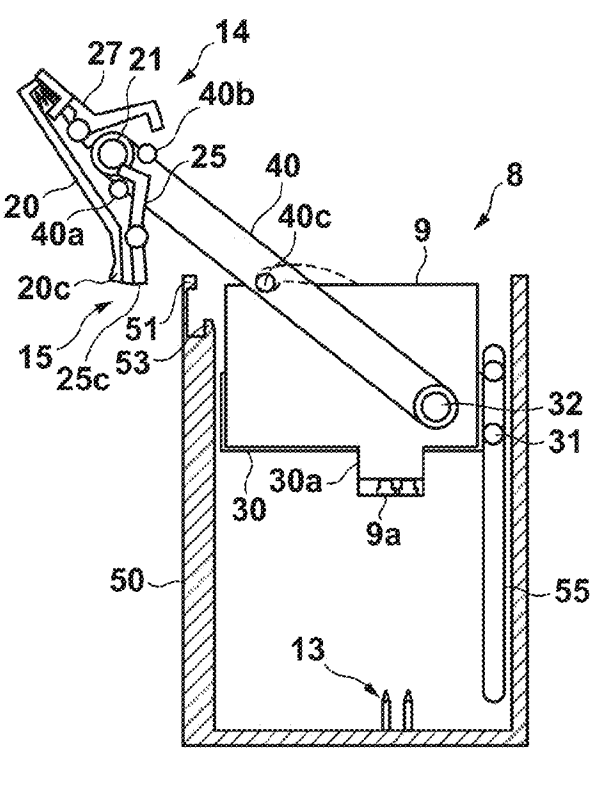

As shown in FIG. 3A, the holder 30 is arranged at the replacement position by a manual operation of the user, and the liquid container 9 is mounted on the holder 30. The liquid container 9 has, at its bottom, connecting portions 9*a* detached from/attached to the supplying portions 13. The liquid container 9 is locked to the holder 30 in a state in which the connecting portions 9*a* have passed through the opening 30*a*. Each connecting portion 9*a* includes, for example, a rubber member into/from which the supplying portion 13 is inserted/removed. An extremely thin slit is cut in each rubber member. Each supplying portion 13 is inserted into/removed from this slit. The rotation restriction unit 15 is in a state of restricting rotation of the operation handle 20 with respect to the link 40.

When the liquid container 9 is mounted on the holder 30, the user grips the operation handle 20 and moves the operation handle 20 in accordance with guidance of the guide portion 56 with respect to the slider 40*c* as shown in FIG. 3B. By gripping the grip portion 20*a* and the grip portion 27*b*, the rotation restriction unit 14 enters a state of releasing restriction of rotation of the operation handle 20 with respect to the link 40, but the rotation restriction unit 15 is in the state of restricting the rotation. It is therefore possible to prevent the operation handle 20 from wobbling and improve the stability.

In this embodiment, the engaging portion 51, the abutment portion 53, the engaging portion 20*c*, and the canceling portion 25*c* are arranged such that the rotation restriction unit 15 releases restriction of rotation of the operation handle 20 with respect to the link 40 upon the start of engagement between the operation handle 20 and the rotation restriction unit 15. This makes it possible to perform a series of operations smoothly. Details will be given as follows.

The operation handle 20 is raised a bit, and then pushed down in a direction of an arrow D. Consequently, the canceling portion 25*c* of the restriction member 25 abuts against the abutment portion 53. The restriction member 25 rotates in a direction of an arrow G, canceling engagement between the hook portion 25*a* and the restriction portion 40*a*. This releases restriction of rotation of the operation handle 20 with respect to the link 40, setting a rotatable state. As shown in FIG. 3C, the user presses the operation handle 20 in a direction of an arrow K. Accordingly, the operation handle 20 rotates with respect to the link 40 in a direction of the arrow K, and the engaging portion 20*c* of the operation handle 20 engages with the engaging portion 51. The operation handle 20 cannot move upward owing to its engagement with the engaging portion 51. The liquid container 9 is pushed down toward the supplying portions 13 by leverage with each of the engaging portion 20*c* and the engaging portion 51 functioning as a fulcrum.

Figure 4A:
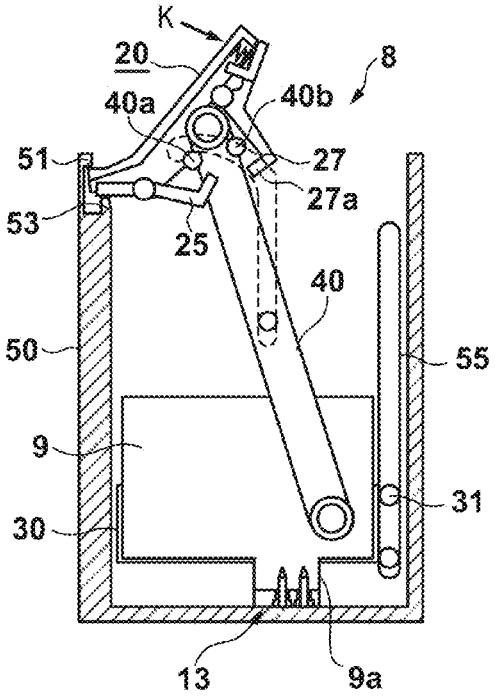
FIGS. 4A and 4B are views for explaining the operation of the supply apparatus in FIGS. 2A and 2B.
Figure 4B:
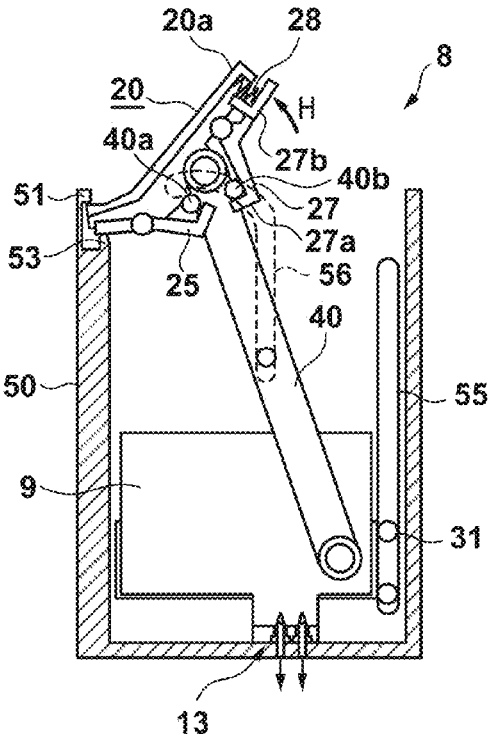

As shown in FIG. 4A, the connecting portions 9*a* contact the supplying portions 13, and the supplying portions 13 are inserted into the connecting portions 9*a*. When reaching a position at which connection between the connecting portions 9*a* and the supplying portions 13 is completed, the user releases the grip portion 27*b* as shown in FIG. 4B. Consequently, the restriction portion 40*b* rotates by biasing by the elastic member 28, and the rotation restriction unit 14 restricts rotation of the operation handle 20 with respect to the link 40. After that, the user can take his/her hand off the operation handle 20. During the series of operations, the operations can be performed with very little change in an operational posture such as the position of the hand or the angle of the wrist, causing no deterioration in the operability.

By a reaction force of the connecting portions 9*a*, a force of pushing up the liquid container 9 is received. However, the rotation restriction unit 14 restricts rotation (in a direction of an arrow H of FIG. 4B, in particular) of the operation handle 20 with respect to the link 40, and an upward displacement of the operation handle 20 by engagement between the engaging portion 51 and the engaging portion 20*c*. It is therefore possible to suppress the floating of the liquid container 9, and maintain connection between the connecting portions 9*a* and the supplying portions 13. Then, ink is discharged from the supplying portions 13.

A removal method of the liquid container 9 will now be described with reference to FIGS. 5A to 5C. The removal method is basically performed in a reverse procedure to that of the attachment method. The rotation restriction unit 14 enters the state of releasing restriction of rotation of the operation handle 20 with respect to the link 40 when the user grips the grip portion 20*a* and the grip portion 27*b*.

Subsequently, the operation handle 20 is pulled up in a direction of an arrow J in FIG. 5B while rotating the operation handle 20 with respect to the link 40 as indicated by the arrow H in FIG. 5A. Consequently, the liquid container 9 starts to lift, canceling connection between the connecting portions 9*a* and the supplying portions 13. In addition, the canceling portion 25*c* of the restriction member 25 is separated from the abutment portion 53. Consequently, the restriction member 25 rotates by biasing by the elastic member 15*a*, engaging the hook portion 25*a* and the restriction portion 40*a* with each other. Then, rotation of the operation handle 20 with respect to the link 40 is restricted.

Figure 5C:
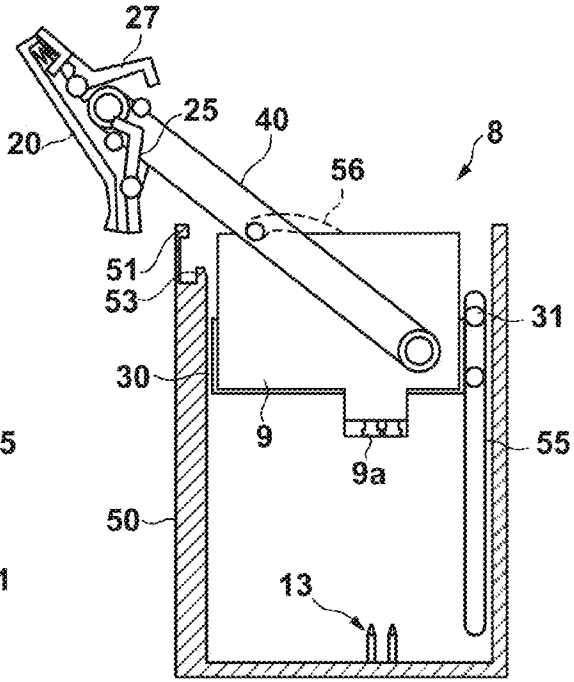
FIGS. 5A to 5C are views for explaining the operation of the supply apparatus in FIGS. 2A and 2B.
Figure 5B:
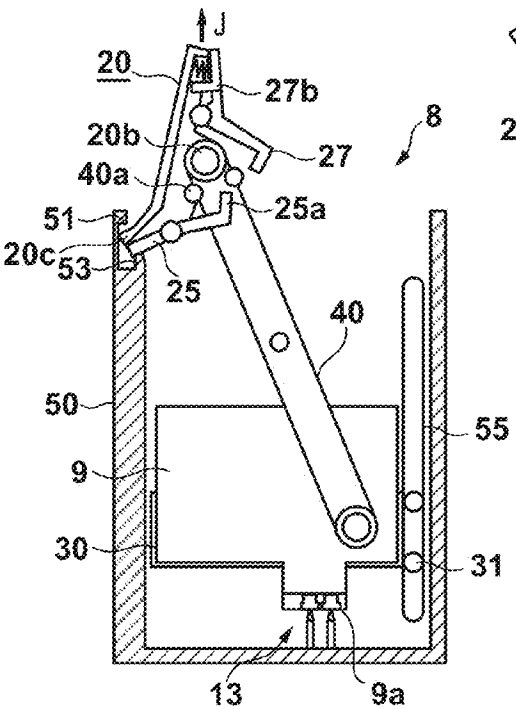
Figure 5A:
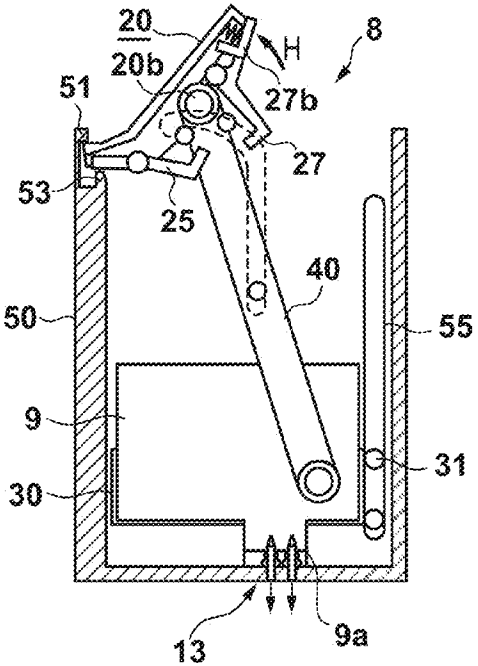

The holder 30 reaches the replacement position as shown in FIG. 5C when the user further pulls up the operation handle 20. In switching to this lift operation, the user can perform the operation without changing his/her fingers holding the operation handle 20. During this lift operation, the rotation restriction unit 15 restricts rotation of the operation handle 20 with respect to the link 40. This makes it possible to improve the stability without the operation handle 20 wobbling.

<Second Embodiment>

If a resistance in inserting/removing supplying portions 13 into/from connecting portions 9*a* of liquid containers 9 is high, an insertion/removal operating force becomes large. In this insertion/removal, it is effective to reduce the insertion/removal operating force by utilizing leverage. This lever ratio is advantageously twice to three times. As described above, however, if the large and small liquid containers 9 can be used in combination, and the lift amount of the small liquid container 9 becomes 150 mm, the total length of a link 40 or the like tends to be longer in an arrangement in which leverage is utilized including a lift operation.

To cope with this, in the first embodiment, an arrangement is adopted in which the leverage is in effect in connecting the connecting portions 9*a* and the supplying portions 13 to each other, and the leverage is not utilized in the lift operation. In this embodiment, an arrangement is adopted in which the leverage is also in effect in canceling connection between the connecting portions 9*a* and the supplying portions 13 while the leverage is not utilized in the lift operation.

Figure 6C:
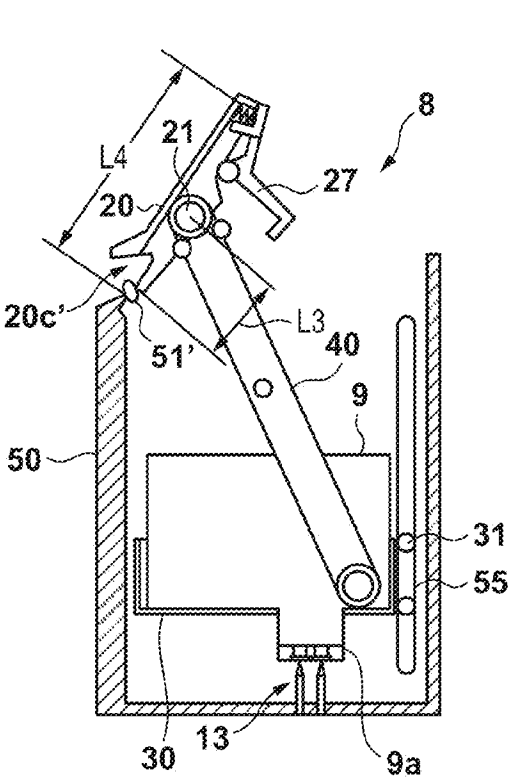
FIGS. 6A to 6C are views for explaining an operation of a supply apparatus in another example.
Figure 6B:
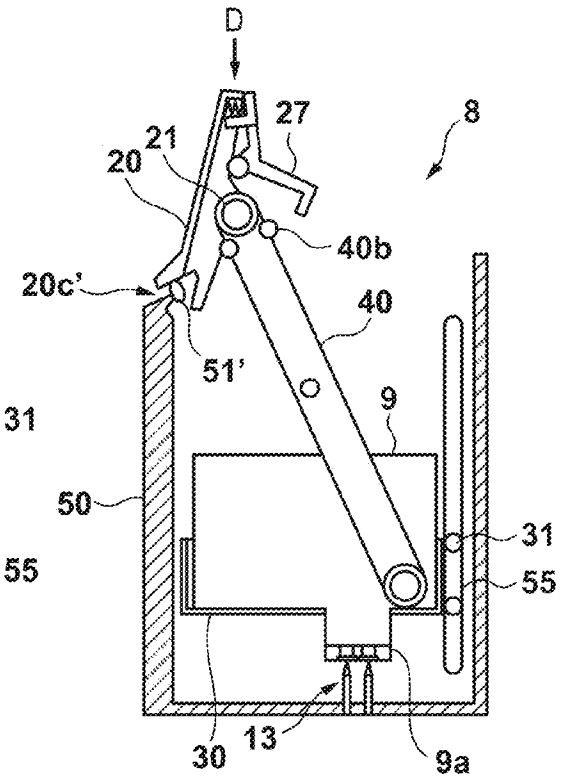
Figure 6A:
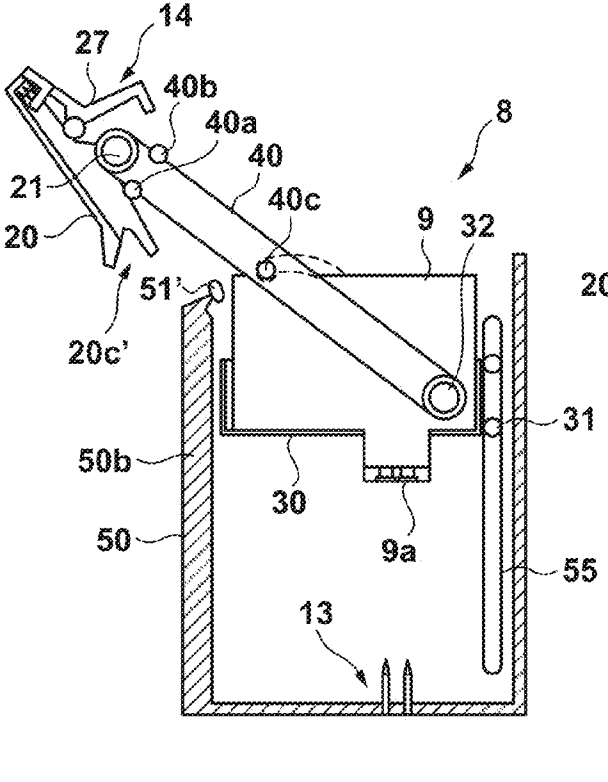

FIGS. 6A to 7C are views for explaining an attaching/detaching operation of the liquid containers 9 according to this embodiment. Referring to FIG. 6A, in this embodiment, an engaging portion 51' and an engaging portion 20*c*' replacing the engaging portion 51 and the engaging portion 20*c* of the first embodiment are employed. Other structures are the same as in the first embodiment.

The engaging portion 51' is formed protruding from a side 50*b* so that the engaging portion 20*c*' can abut against it not only from below but also from above, and is formed into a spherical shape in this embodiment. The engaging portion 20*c*' has a portion which abuts against the engaging portion 51' from below and a portion which abuts against the engaging portion 51' from above. In this embodiment, the engaging portion 20*c*' has a bifurcated beak shape.

Figure 7C:
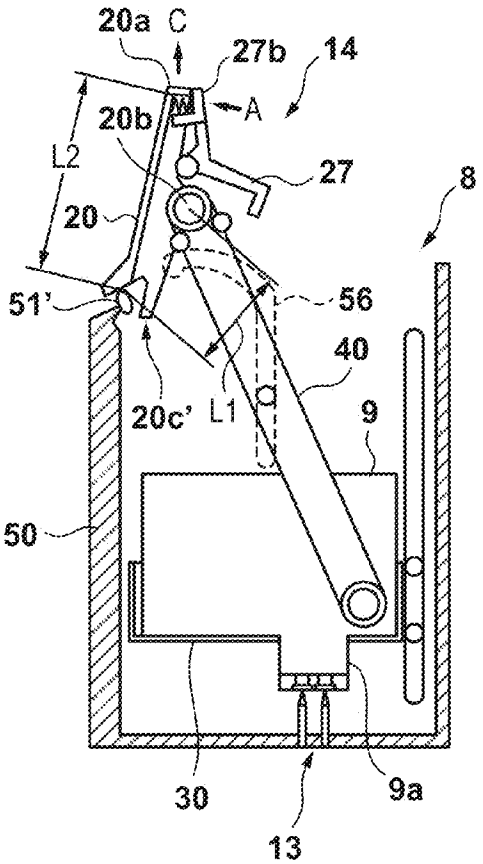
FIGS. 7A to 7C are views for explaining the operation of the supply apparatus in the other example.
Figure 7B:
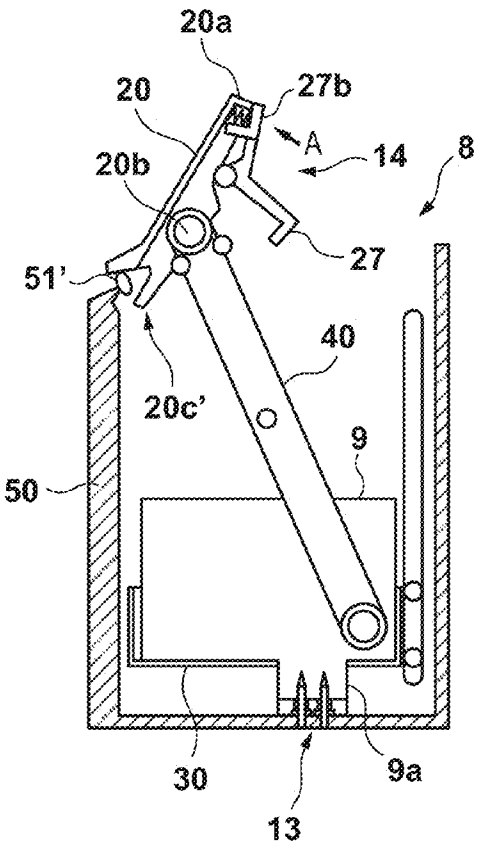
Figure 7A:
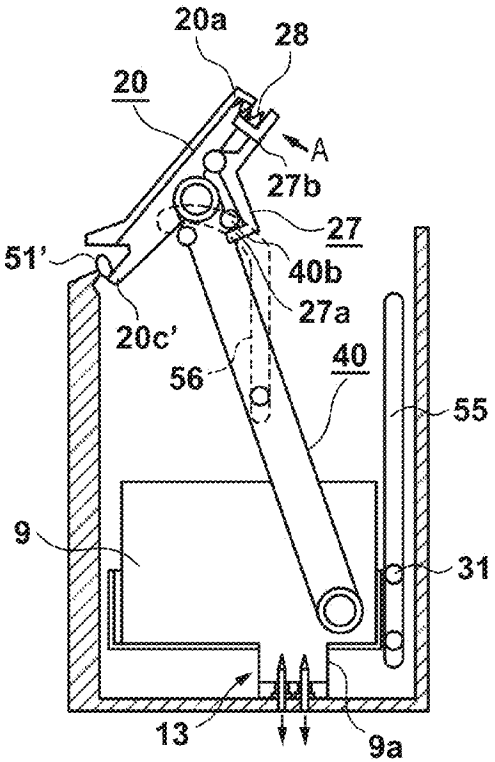
Figure 8B:
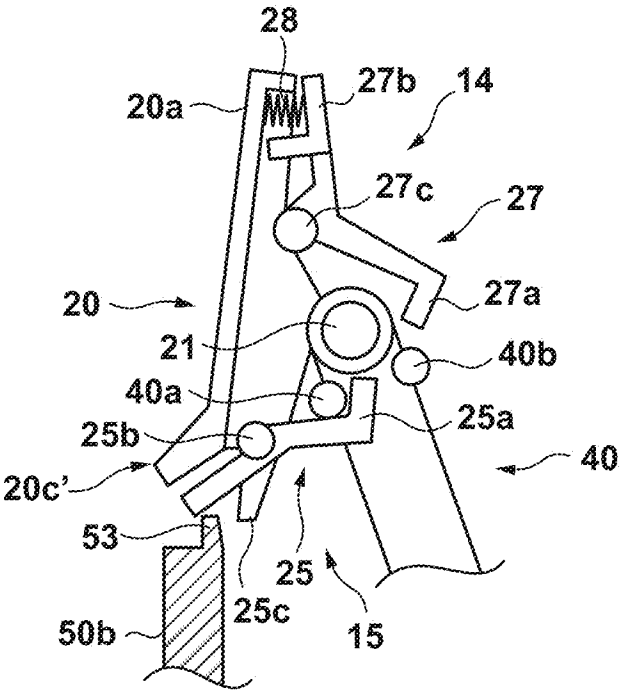
FIGS. 8A and 8B are views for explaining the periphery of an operation handle of the supply apparatus in the other example.
Figure 8A:
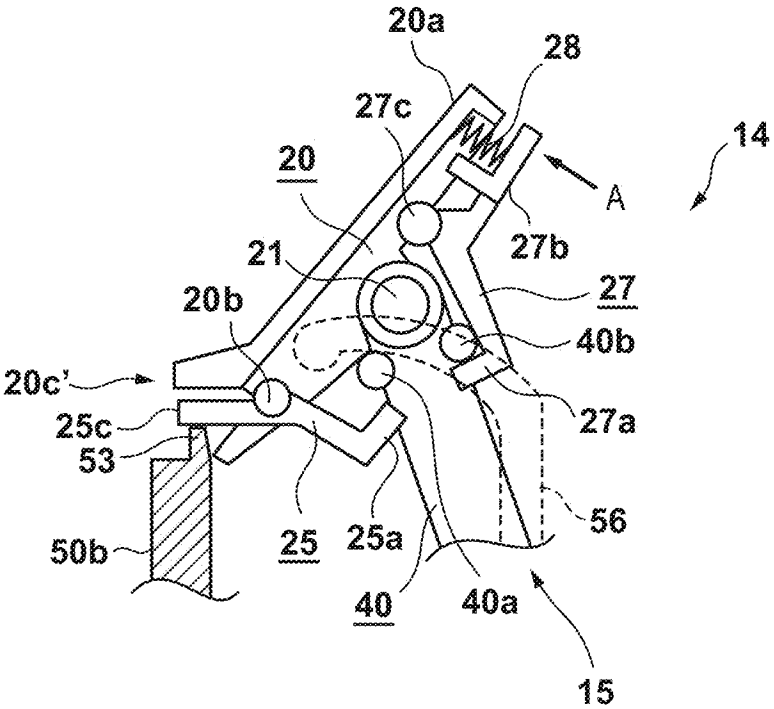

Note that illustration of a rotation restriction unit 15 and an abutment portion 53 is omitted in FIGS. 6A to 7C for the sake of descriptive simplicity, but they are shown in FIGS. 8A and 8B. The arrangements thereof are the same as in the first embodiment. When a canceling portion 25*c* of a restriction member 25 abuts against an abutment portion 53 as shown in FIG. 8A, engagement between a hook portion 25*a* and a restriction portion 40*a* is canceled. When the canceling portion 25*c* of the restriction member 25 is separated from the abutment portion 53 as shown in FIG. 8B, the hook portion 25*a* and the restriction portion 40*a* are engaged with each other by biasing by an elastic member 15*a*.

An attachment method of the liquid container 9 will be described with reference to FIGS. 6A to 7A. As shown in FIG. 6A, a holder 30 is arranged at a replacement position by a manual operation of a user, and the liquid container 9 is mounted on the holder 30. Although not shown, the rotation restriction unit 15 is in a state of restricting rotation of an operation handle 20 with respect to the link 40.

The user grips the operation handle 20 and moves the operation handle 20 in accordance with guidance of a guide portion 56 with respect to a slider 40*c*. By gripping a grip portion 20*a* and a grip portion 27*b*, a rotation restriction unit 14 enters a state of releasing restriction of rotation of the operation handle 20 with respect to the link 40, but the rotation restriction unit 15 is in a state of restricting the rotation. It is therefore possible to prevent the operation handle 20 from wobbling and improve stability.

The operation handle 20 is raised a bit, and then pushed down in a direction of an arrow D as shown in FIG. 6B. Consequently, the canceling portion 25*c* of the restriction member 25 abuts against the abutment portion 53, restriction of rotation of the operation handle 20 with respect to the link 40 is released and the handle 20 becomes a rotatable state, though not shown.

The user presses the side of the grip portion 20*a* of the operation handle 20 downward. Accordingly, the engaging portion 20*c*40 abuts against the engaging portion 51' from below while rotating the operation handle 20. The liquid container 9 is pushed down toward the supplying portions 13 by leverage with each of the engaging portion 20*c*' and the engaging portion 51' being a fulcrum. Accordingly, connection between the connecting portions 9*a* and the supplying portions 13 is started.

At this time, the lever ratio L4/L3 of a distance L4 between the grip portion 20*a* and the fulcrum between the engaging portion 20*c*' and the engaging portion 51' to a distance L3 between the fulcrum and the rotation center of the operation handle 20 acts on a rotation shaft 21. As a result, an operating force is doubled by this lever ratio.

By pressing the operation handle 20 further, the liquid container 9 is lowered, and connection between the connecting portions 9*a* and the supplying portions 13 is completed. The user releases the grip portion 27*b*. Consequently, a restriction portion 40*b* rotates by biasing by an elastic member 28, and the rotation restriction unit 14 restricts rotation of the operation handle 20 with respect to the link 40. After that, the user can take his/her hand off the operation handle 20. During a series of operations, the operations can be performed with very little change in an operational posture such as the position of the hand or the angle of the wrist, causing no deterioration in the operability.

By a reaction force of the connecting portions 9*a*, a force of pushing up the liquid container 9 is received. However, the rotation restriction unit 14 restricts rotation of the operation handle 20 with respect to the link 40, and an upward displacement of the operation handle 20 by engagement between the engaging portion 51' and the engaging portion 20*c*'. It is therefore possible to suppress the floating of the liquid container 9, and maintain connection between the connecting portions 9*a* and the supplying portions 13. Then, ink is discharged from the supplying portions 13 as shown in FIG. 7A.

A detachment method of the liquid container 9 will now be described with reference to FIGS. 7A to 7C. The rotation restriction unit 14 enters the state of releasing restriction of rotation of the operation handle 20 with respect to the link 40 when the user grips the grip portion 20*a* and the grip portion 27*b*.

Subsequently, by rotating the operation handle 20 with respect to the link 40 as indicated by an arrow A in FIG. 7A, the engaging portion 20*c*' abuts against the engaging portion 51' from above as shown in FIG. 7B. The liquid container 9 is pushed up with respect to the supplying portions 13 by the leverage with each of the engaging portion 20*c*' and the engaging portion 51' being the fulcrum. Accordingly, disconnection between the connecting portions 9*a* and the supplying portions 13 is started.

At this time, the lever ratio L2/L1 of a distance L2 between the grip portion 20*a* and the fulcrum between the engaging portion 20*c*' and the engaging portion 51' to a distance L1 between the fulcrum and the rotation center of the operation handle 20 acts on the rotation shaft 21 as shown in FIG. 7C. As a result, the operating force is doubled by this lever ratio.

When connection between the connecting portions 9*a* and the supplying portions 13 is canceled, the user pulls up the operation handle 20. Consequently, the liquid container 9 is lifted, and also the canceling portion 25*c* of the restriction member 25 (not shown) is separated from the abutment portion 53. Consequently, the rotation restriction unit 15 restricts rotation of the operation handle 20 with respect to the link 40.

The holder 30 reaches the replacement position as shown in FIG. 6A when the user further pulls up the operation handle 20. In switching to this lift operation, the user can perform the operation without changing his/her fingers holding the operation handle 20. During this lift operation, the rotation restriction unit 15 restricts rotation of the operation handle 20 with respect to the link 40. This makes it possible to improve the stability without the operation handle 20 wobbling.

<Third Embodiment>

In connection or disconnection between the connecting portions 9*a* and the supplying portions 13 in the first and second embodiments, the leverage acts more effectively by restricting the displacement of the rotation shaft 21. Therefore, a displacement restriction unit may be provided which restricts the displacement of a rotation shaft 21 in a predetermined direction.

Figure 9:
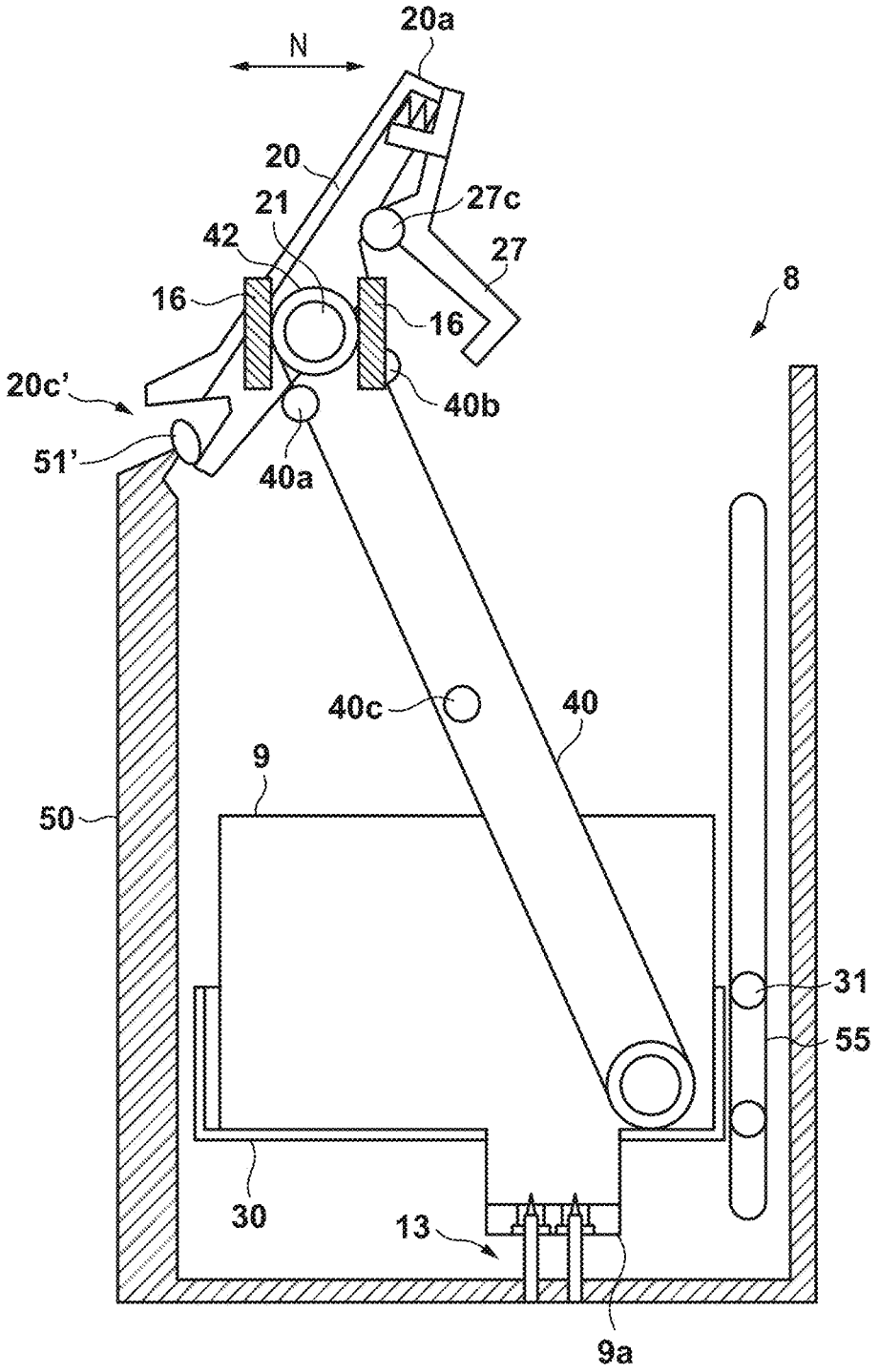
FIG. 9 is a view for explaining a supply apparatus in another example.

FIG. 9 shows an example of this. In the example of FIG. 9, displacement restriction units 16 are provided in the arrangement of the second embodiment. However, they can also be applied to the arrangement of the first embodiment. In this embodiment, the displacement restriction units 16 form a pair of wall portions sandwiching a boss portion around the rotation shaft 21 and are fixed to, for example, one of sides 50*c* facing the containing portion 50.

The displacement restriction units 16 are disposed at a position to sandwich the boss portion around the rotation shaft 21 when connecting portions 9*a* and supplying portions 13 are connected to or disconnected from each other, and restrict a displacement in their N direction. The N direction is a direction crossing (for example, a direction perpendicular to) a direction in which the connecting portions 9*a* and supplying portions 13 are connected to and disconnected from each other. In this embodiment, the direction in which the connecting portions 9*a* and supplying portions 13 are connected to and disconnected from each other is a vertical direction, and thus the N direction is a left-and-right direction.

By providing such displacement restriction units 16, leverage can act more effectively.

<Other Embodiment>

In each of the first to third embodiments, the example has been exemplified in which the liquid containers 9 are the ink tanks containing ink. However, the present invention can also be applied to a liquid container containing a liquid other than ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2015-194401, filed Sep. 30, 2015, which is hereby incorporated by reference herein in its entirety.

What is claimed is:

1. A printing apparatus comprising:

a printhead configured to discharge ink;

a supplying portion configured to be connected to an ink tank containing ink and to supply the ink in the ink tank to the printhead;

a holder configured to hold the ink tank, the holder being movable to a first position at which the ink tank is attachable to and detachable from the holder and a second position at which the ink tank held by the holder is connected to the supplying portion;

a link unit coupled to the holder;

an operation portion rotatably coupled to the link unit, and configured to move the holder through the link unit, the operation portion further being configured to move the holder to the second position by rotation with respect to the link unit;

a rotation restriction unit configured to change the operation portion into a restriction state in which rotation of the operation portion with respect to the link unit is restricted; and a changing unit configured to change the operation portion into a non-restriction state in which the rotation of the operation portion is not restricted by the rotation restriction unit from the restriction state when the holder moves from the first position to the second position.

2. The apparatus according to claim 1, further comprising a second rotation restriction unit configured to releasably restrict rotation of the operation portion with respect to the link unit, wherein restriction by the second rotation restriction unit can be released by a user operation.

3. The apparatus according to claim 1, further comprising a containing portion configured to contain the holder and at least a part of the ink tank mounted on the holder, wherein the supplying portion is provided at a bottom of the containing portion, the holder is provided movable in a direction closer to and away from the bottom in the containing portion, and the rotation restriction unit restricts rotation of the operation portion with respect to the link unit when the holder moves in the direction in the containing portion.

4. The apparatus according to claim 1, further comprising an engaging portion configured to maintain a connection state between the supplying portion and the ink tank mounted on the holder by engaging with the operation portion, wherein the rotation restriction unit changes the operation portion into the non-restriction state upon a start of engagement between the operation portion and the engaging portion.

5. The apparatus according to claim 4, further comprising a second engaging portion configured to engage with the operation portion and function as a fulcrum of leverage in disconnection between the supplying portion and the ink tank mounted on the holder.

6. The apparatus according to claim 4, wherein the engaging portion engages with the operation portion and functions as a fulcrum of leverage in connection between the supplying portion and the ink tank mounted on the holder, and the printing apparatus further comprises a displacement restriction unit configured to restrict a displacement of rotation shafts between the operation portion and the link unit in a predetermined direction in connection between the supplying portion and the ink tank mounted on the holder.

7. The apparatus according to claim 4, wherein the rotation restriction unit includes:

a restriction member rotatably supported by the operation portion, and a restriction portion provided in the link unit and configured to restrict rotation of the operation portion with respect to the link unit by engagement with the restriction member, and wherein the printing apparatus further comprises an abutment portion configured to abut against the restriction member upon a start of engagement between the operation portion and the engaging portion, and to rotate the restriction member in a direction in which engagement with the restriction portion is canceled.

8. The apparatus according to claim 7, wherein the rotation restriction unit further includes an elastic member configured to bias the restriction member in a direction in which the restriction member engages with the restriction portion.

9. The apparatus according to claim 7, further comprising a containing portion configured to contain the holder and at least a part of the ink tank mounted on the holder, wherein the supplying portion is provided at a bottom of the containing portion, the holder is provided movable in a direction closer to and away from the bottom in the containing portion, and the engaging portion and the abutment portion are provided in a wall portion of the containing portion.

10. An attachment method of an ink tank to a printing apparatus, the printing apparatus including:

a printhead configured to discharge ink, a supplying portion configured to be connected to an ink tank containing ink and to supply the ink in the ink tank to the printhead, a holder configured to hold the ink tank, the holder being movable to a first position at which the ink tank is attachable to and detachable from the holder and a second position at which the ink tank held by the holder is connected to the supplying portion, a link unit coupled to the holder, an operation portion rotatably coupled to the link unit, and configured to move the holder through the link unit, the operation portion further being configured to move the holder to the second position by rotation with respect to the link unit, a rotation restriction unit configured to change the operation portion into a restriction state in which rotation of the operation portion with respect to the link unit is restricted, and a changing unit configured to change the operation portion into a non-restriction state in which the rotation of the operation portion is not restricted by the rotation restriction unit from the restriction state when the holder moves from the first position to the second position, the method comprising:

mounting the ink tank on the holder;

moving, to the supplying portion, the ink tank mounted on the holder by moving the operation portion; and connecting the supplying portion and the ink tank mounted on the holder by rotating the operation portion, wherein the rotation restriction unit restricts rotation of the operation portion with respect to the link unit in the moving and releases a restriction by the rotation restriction unit in the connecting.

* * * * *